US005110237A

United States Patent [19]

Hesse

[11] Patent Number: 5,110,237

[45] Date of Patent: May 5, 1992

[54] RAMMING DEVICE

[75] Inventor: Alfons Hesse, Lennestadt, Fed. Rep. of Germany

[73] Assignee: Paul Schmidt, Lennestadt, Fed. Rep. of Germany

[21] Appl. No.: 245,825

[22] Filed: Sep. 16, 1988

[30] Foreign Application Priority Data

Oct. 16, 1987 [DE] Fed. Rep. of Germany ..... 3734998

[51] Int. Cl.[5] ..... E02F 5/18

[52] U.S. Cl. ..... 405/184; 173/128; 405/232

[58] Field of Search ..... 405/184, 253, 231, 232; 72/393; 173/128, 131, 132

[56] References Cited

U.S. PATENT DOCUMENTS

| | | | |
|---|---|---|---|
| 943,117 | 12/1909 | Lucas et al. | 72/393 |
| 1,048,584 | 12/1912 | Rich | 72/393 |
| 1,057,664 | 4/1913 | Patterson | 72/393 |
| 1,954,070 | 4/1934 | Cook | 405/253 X |
| 2,151,847 | 3/1939 | Greulich | 405/253 |
| 2,902,832 | 9/1959 | Levy et al. | 405/184 X |
| 3,227,483 | 1/1966 | Guild et al. . | |
| 3,899,891 | 8/1975 | Kelly | 405/253 X |
| 3,991,833 | 11/1976 | Ruppert . | |
| 4,460,050 | 7/1984 | Schmidt | 173/128 |
| 4,550,784 | 11/1985 | Ottestad et al. | 173/128 X |
| 4,650,374 | 3/1987 | Schmidt | 405/184 |
| 4,671,703 | 6/1987 | Schmidt | 405/184 |

FOREIGN PATENT DOCUMENTS

| | | |
|---|---|---|
| 3203408 | 8/1983 | Fed. Rep. of Germany . |
| 2276428 | 1/1976 | France . |
| 2502662 | 1/1982 | France . |
| 7704561 | 10/1978 | Netherlands . |

*Primary Examiner*—Dennis L. Taylor
*Attorney, Agent, or Firm*—Toren, McGeady

[57] ABSTRACT

In a device for driving-in pipes by means of a connecting piece engaging in the rear end of the pipe and a rammer engaging in the connecting piece, flanging of the back end of the pipe can be prevented by forming the connecting piece as an expanding ring having a cylindrical outer face and an inner cone.

9 Claims, 5 Drawing Sheets

RAMMING DEVICE

TECHNICAL FIELD OF THE INVENTION

The invention relates to a device for driving in pipes which comprises a rammer having a connecting piece engaging in the rear end of the pipe.

BACKGROUND OF THE INVENTION AND PRIOR ART

In order to drive steel pipes into the ground a conical impact tip of a rammer engages directly or via a rammer extension or connecting piece in the rear end of a pipe called a following thrust pipe. From DE-OS 33 26 246 a connecting piece is known which is provided with an outer cone engaging in the rear end of a pipe guided on bearing blocks, and concentrically with an inner cone to receive the impact tip of the rammer. Between the outer cone and the inner cone of the connecting piece there are outlet openings for the earth collecting in the inside of the pipe as ramming proceeds.

It has been found that owing to the cone-connection between the rammer and the pipe, the rear end of the thrust pipe is often expanded over the cone to form a flange. This has the disadvantage that the flanged-out end of the pipe must be cut off before the next pipe can be welded on flush with the rear end of the thrust pipe which has been driven in the ground. The flanged pipe ends are usually cut off with a flame-cutting machine. Owing to the restricted space in an excavation the flanged pipe ends cannot, however, be cut off accurately enough, with the result that gaps are often formed between the rear end of the thrust pipe that has already been driven in and the front end of the pipe to be connected to it. Since the thrust of the rammer is transmitted through the weld seam connecting the two pipes into the thrust pipe already in the ground, such gaps must be bridged completely by the weld deposit, which presents great problems in the excavation.

OBJECT OF THE INVENTION

The object of the invention is to prevent the flanging of the rear end of the thrust pipe.

BRIEF DESCRIPTION OF THE INVENTION

This object is achieved according to the invention in that the connecting piece is formed as an expanding ring that preferably has a inner cone and advantageously at least one earth outlet opening. The expanding ring, preferably provided with a circumferential collar at the back end (in the direction of thrust) is pushed into the rear end of the thrust pipe until the circumferential collar abuts against the face of the pipe wall. The cone of the impact tip of the rammer engaging in the inner cone of the expanding ring, which can if desired be arranged completely in the thrust pipe as long as an expanding ring without a circumferential collar is used, so that the rammer together with the expanding ring can be introduced completely into the pipe before it is put in operation, sits fast in the cone of the expanding ring after a few blows of the ram and the expanding ring expands radially outwards and thereby presses with its cylindrical outer periphery against the inner wall of the pipe. Flanging of the rear end of the thrust pipe is thus reliably avoided and the thrust pipes can already be cut with bevelled ends and deburred in the workshop before they are subsequently transported to the building site.

The cylindrical outer face of the expanding ring can have a rough surface, and preferably be provided with denticulation. By this means the grip on the inner wall of the cylindrical outer face pressed against the interior of the thrust pipe is improved. The expanding ring can also be formed with axial steps, for example by fitting expanding rings having different diameters into one another; alternatively, the stepped expanding ring can be integral. In any case a stepped expanding ring makes adaptation to different pipe diameters possible.

The expanding ring can advantageously be divided into a plurality of ring segments, i.e. multiply radially divided, preferably into three ring segments with a gap between neighbouring faces. For example, three quarter-ring segments, i.e. three segments of an expanding ring divided into four ring segments, can be arranged uniformly around the circumference at the rear end of the thrust pipe; between the neighbouring sides of the three quarter-ring segments there are then sufficient gaps formed to guarantee trouble-free removal of earth from the interior of the pipe. The neighbouring faces of the ring segments can, in order to enlarge the cross-section of the gap, be provided with recesses forming gaps that are preferably trefoil-shaped. According to the size of the recesses made in the faces, any desired size of outlet openings can thus be made, for undisturbed removal of earth. An expanding ring divided radially many times, e.g. into fifty segments, can be used for pipes and rammers having different diameters, since, according to the number of segments used, different diameter ranges can be achieved. Any multi-segment ring comprising more than four ring segments can be adapted to different diameters.

A rammer cone can advantageously be arranged radially between an impact tip and the inner cone. By means of the interposed rammer cone it is possible to adapt the expanding ring of limited diameter of the ring segments, for example in the case of third-or quarter-ring segments, to different diameters of the thrust pipe or the rammer or its impact tip, i.e. a separate set of ring segments is not necessary for each pipe diameter.

It is advisable to have a support surrounding the ring segments. A support, e.g. a ring-shaped spiral spring or a rubber ring which surrounds the segments radially assists transport and assembly.

BREIF DESCRIPTION OF THE DRAWINGS

The invention will now be described in more detail with reference to exemplary embodiments shown in the drawings, in which.

DETAILED DESCRIPTION OF PREFERRED EMBODIMENTS OF THE INVENTION

Figure 2:
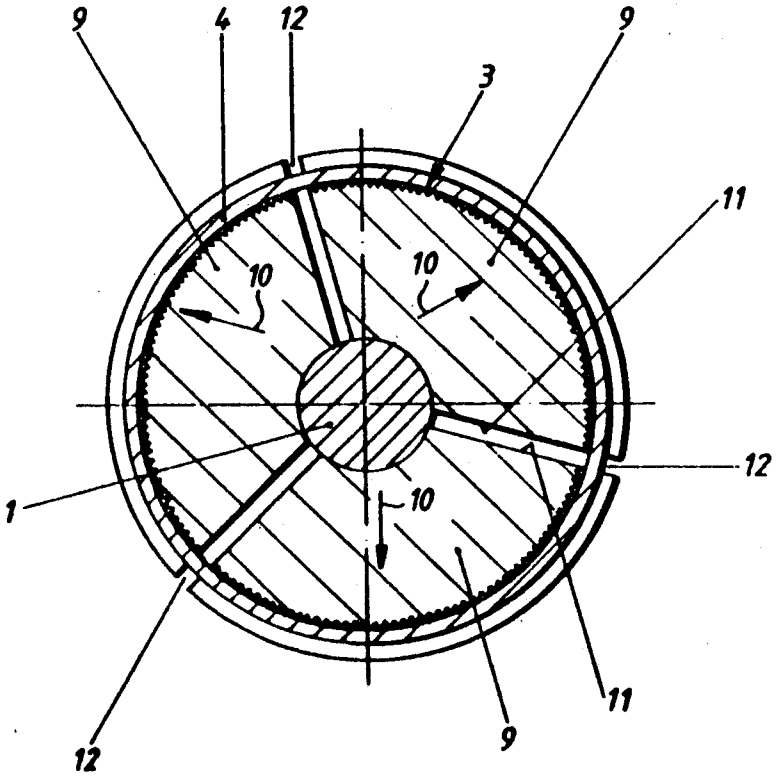
FIG. 2 shows a section along the line II—II in FIG. 1.
Figure 1:
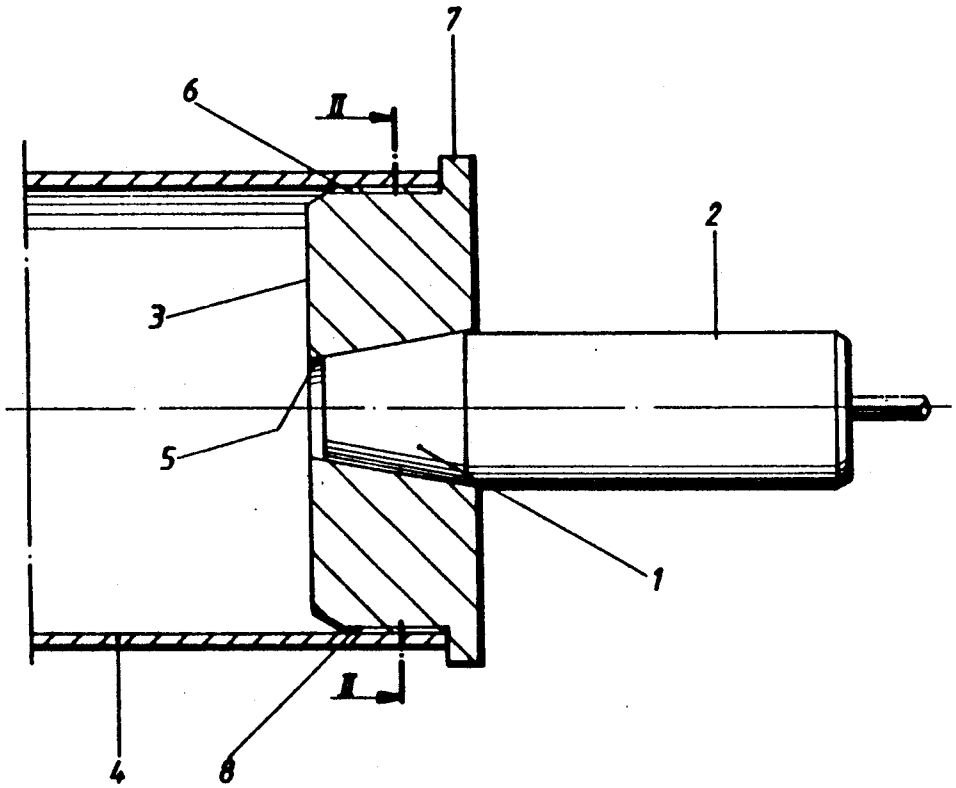
FIG. 1 shows, in longitudinal section, the rear end of a thrust pipe with a segmented expanding ring arranged therein and a rammer head engaging in an inner cone of the expanding ring.

In the case of horizontal rammers, a rammer (not shown) engages with a conical impact tip 1 of a rammer head 2 through an expanding ring 3 into the rear end of the thrust pipe 4 to be driven into the ground. The connection between the rammer and the thrust pipe 4 is made by the impact tip 1 of the rammer head 2 engaging in an inner cone 5 of the expanding ring 3. When driving the pipe forward the impact tip 1 sits firmly in the inner cone, after a few impacts, and pushes the expanding ring 3 having a cylindrical outer face 6 firmly against the inner wall of the pipe 4. The cylindrical outer face 6 of the expanding ring 3 pushed into the pipe 4 up to a stop position limited by a circumferential collar 7 is provided with denticulation 8 assisting the grip.

As shown in FIG. 2, the expanding ring 3 comprises 3 ring segments 9 of an expanding ring 3 divided radially three times. When the impact tip 1 penetrates the inner core 5 of the expanding ring 3 the ring segments 9 are pressed radially outwards in the direction of the arrow 10 against the inner wall of the thrust pipe 4. As a result the neighbouring faces 11 of the ring segments 9 part from one another; the faces 11 define gaps 12 between the ring segments 9. The earth accumulating in the interior of the pipe with the progressive ramming of the pipe 4 into the ground leaves by way of the gap 12 between the ring segments 9, i.e. the earth flows off outwardly in the direction of flow and does not need to be diverted to the side.

Figure 4:
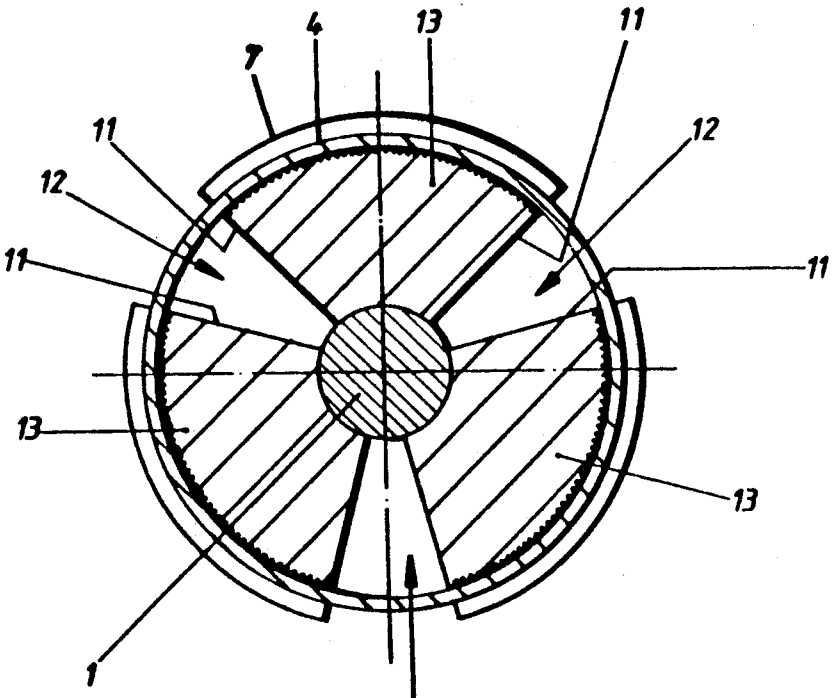
FIG. 4 shows a section along the line IV—IV in FIG. 3.
Figure 3:
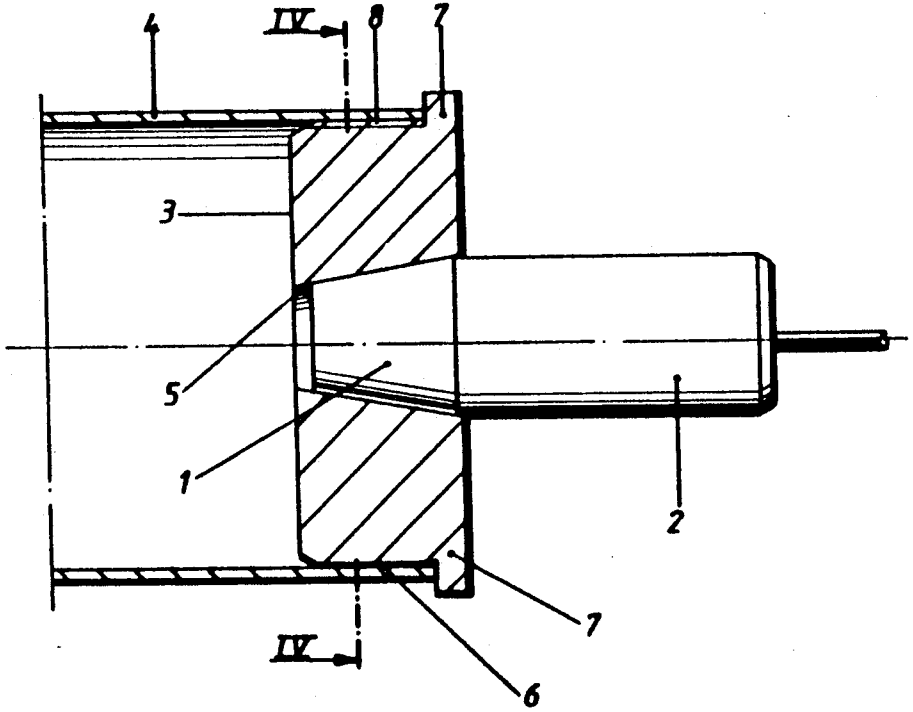
FIG. 3 shows a representation as shown in FIG. 1 with an expanding ring made up of three quarter-ring segments.

In the embodiment shown in FIGS. 3 and 4, the expanding ring 3 comprises three quarter-ring segments 13 distributed uniformly over the circumference, i.e. of an expanding ring 3 divided into four identical ring segments only three quarter-ring segments 13 are used. The gaps 12 defined by the neighbouring faces 11 of the quarter-ring segments 13 are considerably larger than the gaps in the case of third-ring segments 9 (cf. FIG. 2), which makes it easier for the earth to leave the interior of the pipe 4.

Figure 6:
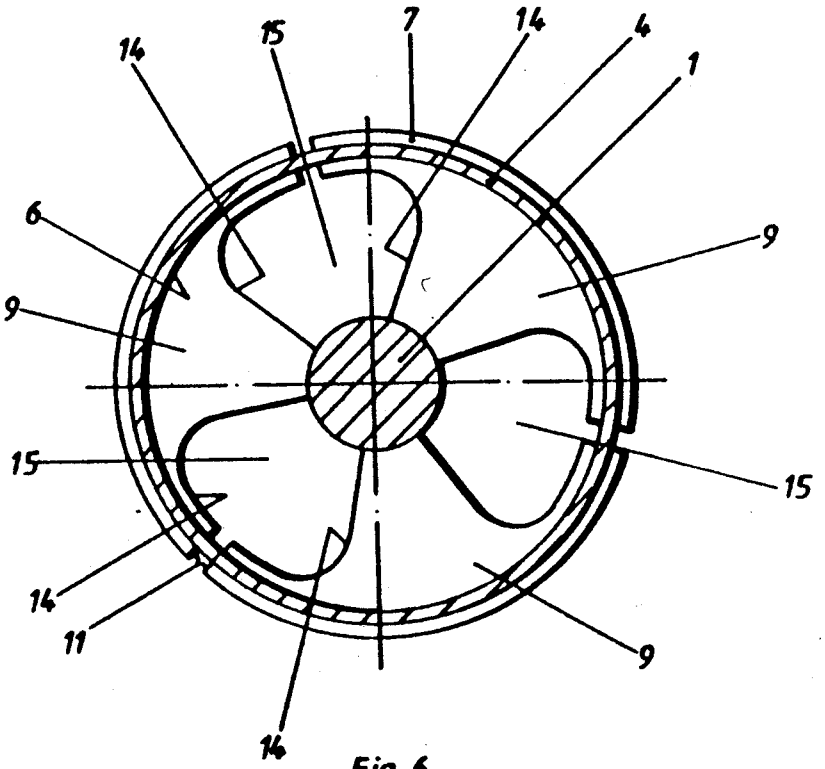
FIG. 6 shows a section along the line VI—VI in FIG. 5.
Figure 5:
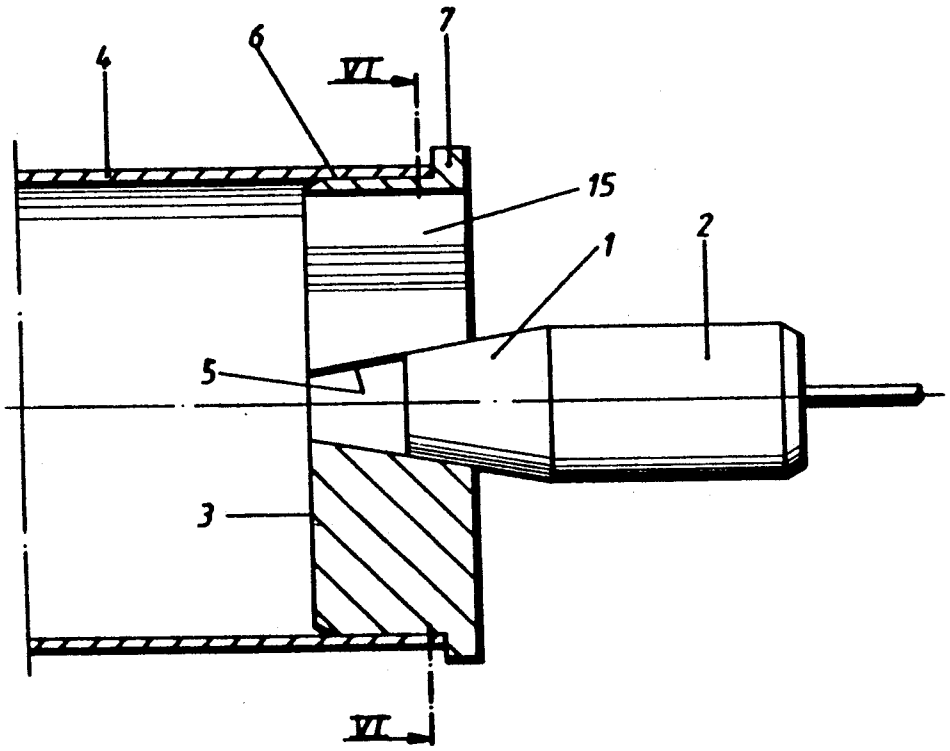
FIG. 5 shows a representation as shown in FIG. 1 with an expanding ring which has trefoil-like gaps between neighbouring faces of the ring segments.
Figure 8:
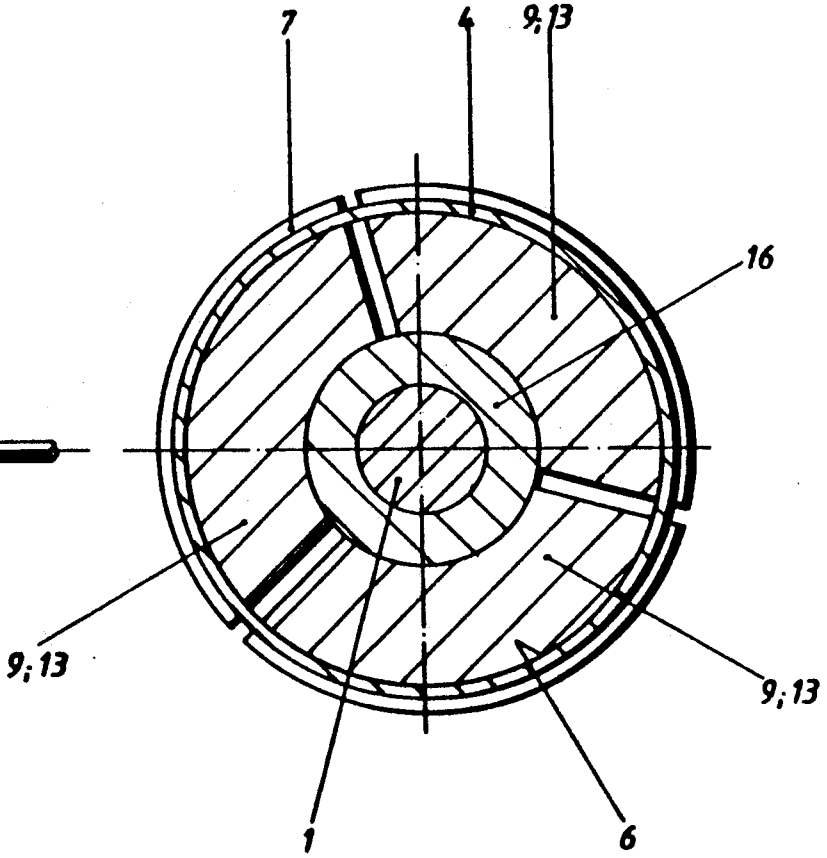
FIG. 8 shows a section along the line VII—VII in FIG. 7.

As shown in FIG. 6 for third-ring segments 9, gaps 15 of even larger cross-section are obtained for the removal of earth by recesses 14 in the faces 11 of the ring segments 9. In the embodiment shown in FIG. 6 the recesses 14 of neighbouring faces 11 form trefoil-shaped gaps 15.

Figure 7:
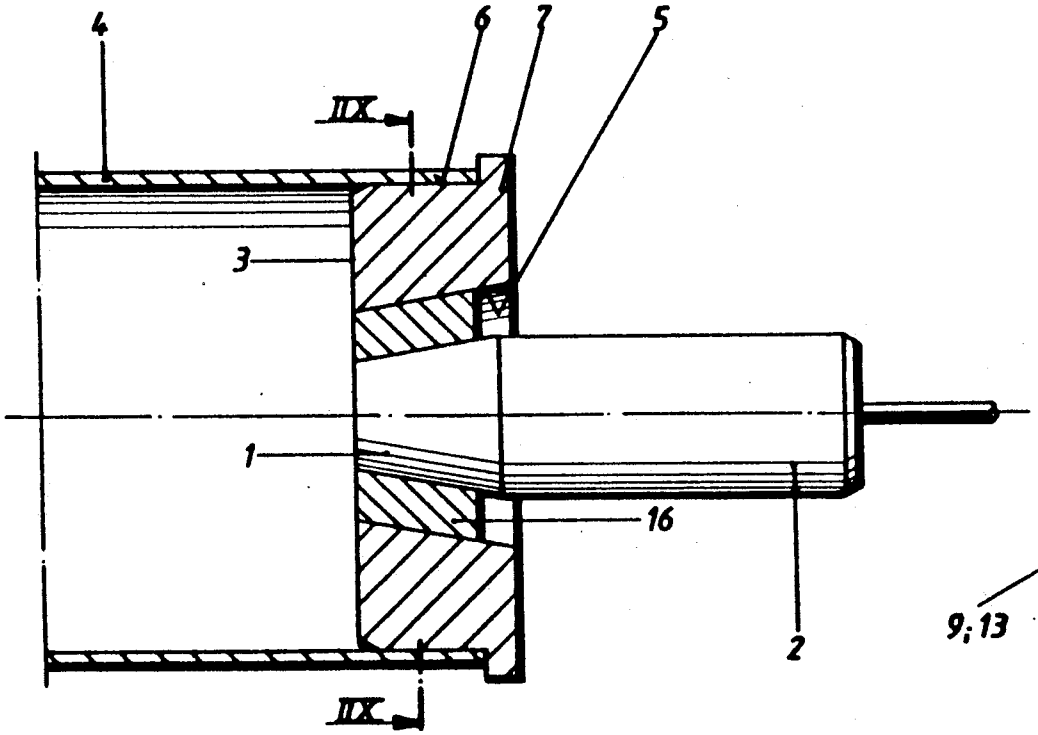
FIG. 7 shows a representation as shown in FIG. 1 with a rammer cone arranged between an impact tip of the rammer head and the expanding ring.

The ring segments 9 and 13 of an expanding ring 3 are, as shown in FIG. 7, adapted by a rammer cone 16 to pipes 4 having different diameters. The rammmer cone 16, both internally and externally conical, is for this purpose arranged between the impact tip 1 of the rammer head 2 and the inner cone 5 of the expanding ring 3 or the ring segments 9, 13.

Figure 9:
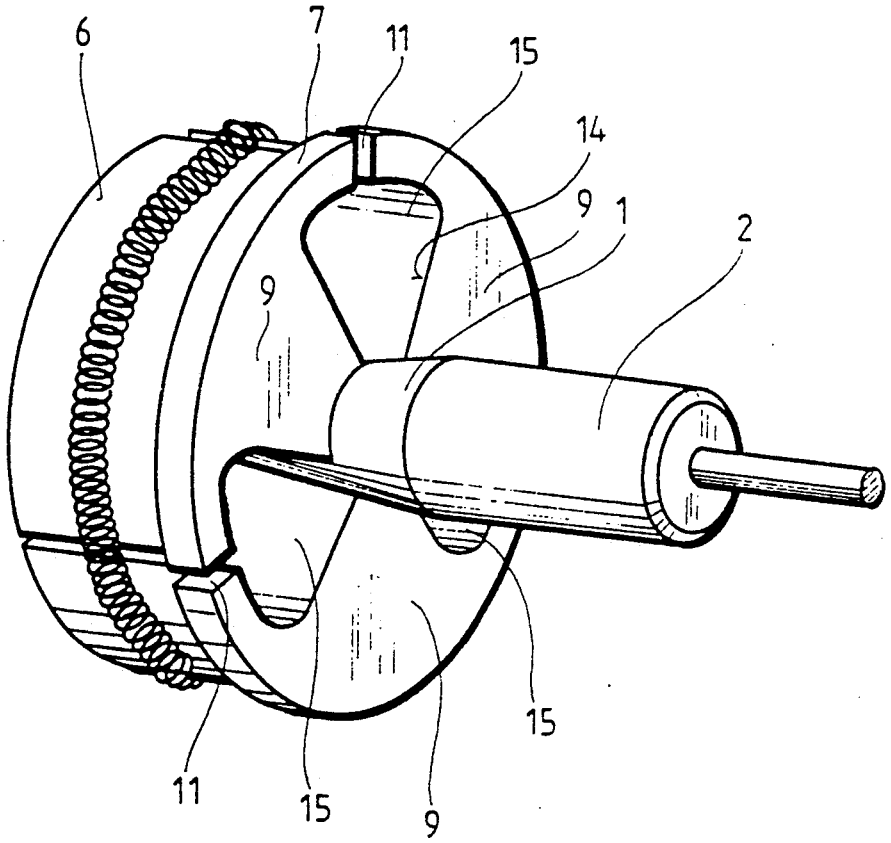
FIG. 9 shows a support surrounding the ring segments.

FIG. 9 perspectively illustrates a hose-shaped spring surrounding and supporting the ring segments.

What is claimed is:

1. A device for driving in a pipe, comprising:

a connecting piece engageable into a rearward end of the pipe and having at least one earth outlet opening; and a ram having a conical striking tip 1 engageable into the connecting piece, the connecting piece being comprised of an expansion ring 3 having an outer face which forms a relatively flat surface, and an inside cone arranged on the conical striking tip 1 of the ram, the expansion ring 3 widening radially outwards across its entire length so as to press with its cylindrical outer circumference 6 against an inner wall of the pipe 4 to be driven in, the expansion ring 3 further having a collar 7 arranged at its rear end so as to act as a stop for the pipe.

2. A device according to claim 1, wherein the expansion ring is divided into ring segments.

3. A device according to claim 1, wherein the expansion ring comprises three ring segments arranged with a gap between neighbouring faces.

4. A device according to claim 2, wherein neighbouring sides of the ring segments have recesses.

5. A device according to claim 1 wherein the cylindrical outer face of the expansion ring has a rough surface.

6. A device according to claim 5, wherein the outer face of the expansion ring is denticulated.

7. A device according to claim 1, wherein a circumferential collar is arranged at the back end, in a thrust direction, of the expansion ring.

8. A device according to claim 1, wherein a rammer cone is arranged radially between an impact tip and the inside cone of the expansion ring.

9. A device according to claim 2, wherein a support surrounds the ring segments.

* * * * *